US005937535A

United States Patent [19]

Hoffman, Jr. et al.

[11] Patent Number: 5,937,535

[45] Date of Patent: Aug. 17, 1999

[54] DRYER ASSEMBLY FOR CURING SUBSTRATES

[75] Inventors: Richard C. Hoffman, Jr., St. Charles; Laurence A. Iaccino, Mount Prospect; Mariusz Switalski, Schiller Park, all of Ill.

[73] Assignee: M&R Printing Equipment, Inc., Glen Ellyn, Ill.

[21] Appl. No.: 08/732,516

[22] Filed: Oct. 15, 1996

[51] Int. Cl.[6] ..... F26B 19/00

[52] U.S. Cl. ..... 34/78; 34/77; 34/267; 34/269; 118/65

[58] Field of Search ..... 34/75, 76, 77, 34/78, 266, 267, 268, 269, 219

[56] References Cited

U.S. PATENT DOCUMENTS

| | | | |
|---|---|---|---|
| 4,756,091 | 7/1988 | Van Denend | 34/266 |
| 4,996,939 | 3/1991 | D'Amato | 118/65 |

OTHER PUBLICATIONS

Vaisala brochure and specifications published at least as early as Sep. 1995.

Exergen brochure and specifications published as least as early as Sep. 1995.

"Sprint Modular Textile Gas Dryer" brochure, Feb. 20, 1995.

"Sprint 'S' Modular Textile Gas Dryer" brochure, Mar. 6, 1995.

*Primary Examiner*—Henry Bennett
*Assistant Examiner*—Pamela A. Wilson
*Attorney, Agent, or Firm*—Wallenstein & Wagner, Ltd.

[57] ABSTRACT

A dryer (10) for printed textiles and substrates is disclosed having a plurality of infrared-based sensors (60) therein for monitoring the temperature of the products as opposed to the ambient environment. Each sensor (60) is positioned within a projecting sensor housing (55,58). The sensor housing (55,58) has an annular chamber (70) to protect and cool the sensor (60). A chilling/dehumidifying system (100) is also disclosed that incorporates a dehumidifier (110) and, humidity monitors (160).

19 Claims, 4 Drawing Sheets

10
11
12
14
15
16
17
18
20
21
22
25
26
27
28
29
30
50
55
56
58
59
60
70
71
72
100
A
D1
D2
5

DRYER ASSEMBLY FOR CURING SUBSTRATES

DESCRIPTION

1. Technical Field

The present invention relates generally to an assembly for curing inked textiles and substrates and, more particularly, to a novel dryer containing a cooling section and a plurality of spaced apart infrared sensors and humidistats therein to more aptly monitor the temperature and humidity of the inked product travelling therein.

2. Background Prior Art

Indicia applied permanently to articles of clothing and other textiles have become very popular. Fanciful indicia, such as logos, slogans, college names, sports team names and sayings, are now commonplace. As a result, screen printing has become very popular. Large, commercial operations for screen printing textiles are common today.

Indicia on a textile or substrate (e.g., for transfers) can be one or more colors. Typically, a screen printing machine has at least one station for each color employed. For example, a design incorporating two colors will have at least two printing stations, one for each color. A design employing eight colors will have at least eight stations. Each station generally includes a printing head, which supports a single screen, the ink that is used at that station and a mechanism for applying the ink to the textile. Each color is carried by a single screen. The textile to be screened travels from printing station to printing station by one of a number of methods, such as a chain or a rigid arm. The textile is usually carried by a metal pallet, pallet support, flat bed, or platen. Common printing machines include turret, oval and linear.

Some printing machines incorporate curing stations therein. Other operations employ separate dryers. A dryer has two primary components, a conveyor system and a heating system. At present, the drying of a textile or substrate with printing thereon is performed by the operator first setting the temperature inside the dryer and setting the speed of the conveyor system. Commonly known mechanisms may be employed to determine/read the ambient temperature somewhere in the dryer, permitting the operator to adjust the conveyor speed to compensate for temperatures too high or too low.

Numerous inks are available in the industry from many different producers. Such inks include water base, sublimation and plastisol. The ink is cured or gelled on the textile or substrate to a critical temperature. The temperature during the curing process must be kept within a window suitable for the ink-curing conditions, typically between 125° F. to 450° F. Unfortunately, with some inks and/or textiles, temperatures are crucial. The quality and lifetime of a product may be negatively affected by incorrect temperatures. For example, with plastisols, the temperature must reach 320° F.; the time for this heating can be less relevant. However, in a range (below 320° F. or above 350° F.), the plastisol will not properly set, resulting in cracking, or it may become liquified. For example, if the temperature is too low, the plastisol will not cure properly, and will not adhere to the textile/substrate; if the temperature exceeds 350° F., the plastisol will over-gel. Similarly, if a dye in the textile is overheated, it will migrate. And, the textile or substrate may scorch or burn, thereby ruining the product and increasing waste and production costs.

As a result, there is a need to both monitor the dryer's temperature in multiple locations and to sense the temperature of the textile/substrate and/or ink on the textile/substrate, as opposed to the ambient temperature of the system.

Another important variable is humidity. It is beneficial to monitor this variable also to ensure the product is not moist or becomes moist.

In an effort to fulfill these needs and to continuously improve upon the screening/printing process and machines available in the marketplace, the following advancements and improvements were developed to the apparatus and method of drying textiles and substrates once they have been inked and printed upon.

SUMMARY OF THE INVENTION

According to a first aspect of the present invention, an apparatus and method are disclosed for drying substrates and/or textiles. A dryer for curing substrates or textiles with printings thereon is disclosed. The system includes, generally, a heating section, a cooling section, a plurality of infrared-based heat temperature sensors and a plurality of humidity sensors.

In particular, a dryer housing having an entrance and an exit, means therein for heating the substrates within the dryer housing, and a conveyor system for moving the substrates from the entrance to the exit, includes a plurality of temperature sensors within the dryer housing longitudinally spaced apart between the entrance and exit. These sensors are each infrared-based and placed in a sensor housing projecting into the dryer housing. The sensors themselves have an internal air purging system for cooling the sensor. In addition, the sensor housing has a separate external air purging system comprised of an annular chamber formed between an inner chamber wall and an outer chamber wall and two air-lines carrying air into and out of the annular chamber. The inner chamber wall is a tubular wall (cylindrical) having a first diameter and the outer chamber wall is a tubular wall (rectangular) having a second diameter, the first diameter being less than the second diameter. Both tubular walls are secured at one end to the dryer housing and are open to the inside of the dryer housing at the other, distal end. The inner chamber wall and external chamber wall are concentric tubular walls secured at one end to the top wall of the dryer housing and are open to the inside of the dryer housing at the other, distal end. The physical sensor is contained within the inner tubular wall.

An air-line carrying air into the annular chamber is connected at the one end of each of the tubular walls adjacent the dryer's top wall. And, a second air-line is connected at the same end of the tubular walls removing air from the annular chamber. These air-lines are annularly spaced apart. The air-lines and chamber walls are adapted to pass air from the first air-line and the annular chamber over the opening in the tubular walls and the sensor and back into the annular chamber and into the second air-line.

In addition, dehumidifying means are provided for removing moisture from any air entering the heating elements of the dryer. This dehumidifying means further cools the substrates within the dryer before they are touched by workers. A heat exchanger receives the dehumidified air and preheats this air directed to the burner assembly by air exhausting from the dryer.

Humidity detectors are also provided for monitoring the moisture of the dehumidified air.

Other advantages and aspects of the present invention will become apparent upon reading the following description of the drawings and the detailed description of the invention.

BRIEF DESCRIPTION OF DRAWINGS

To understand the present invention, it will now be described by way of example, with reference to the accompanying drawings in which.

DETAILED DESCRIPTION

Figures 1, 2:
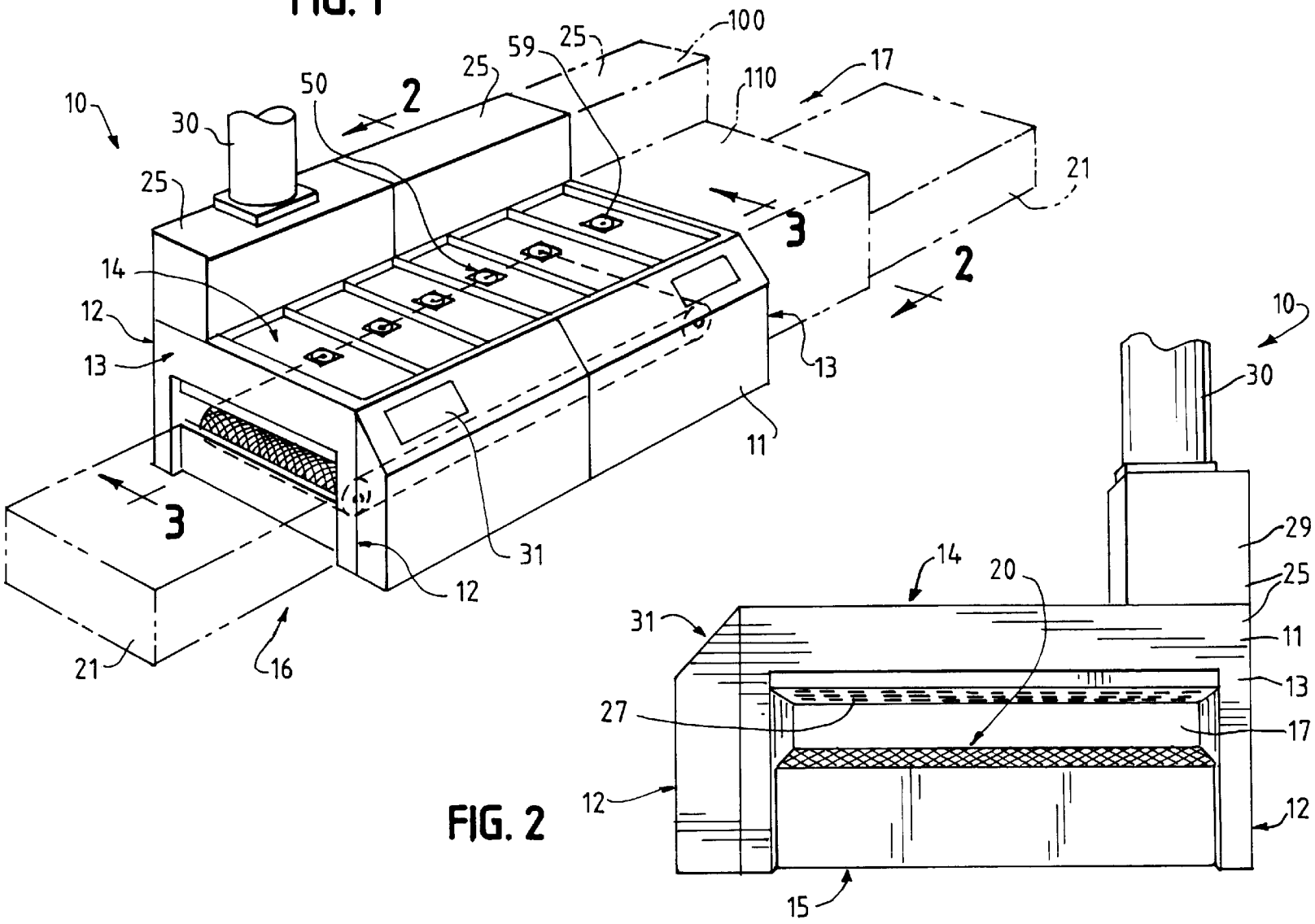
FIG. 1 is a side perspective view of a dryer assembly made in accordance with the teachings of the present invention.
FIG. 2 is a sectional view of the dryer assembly along line 2—2 in FIG. 1.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figures 3, 4, 5:
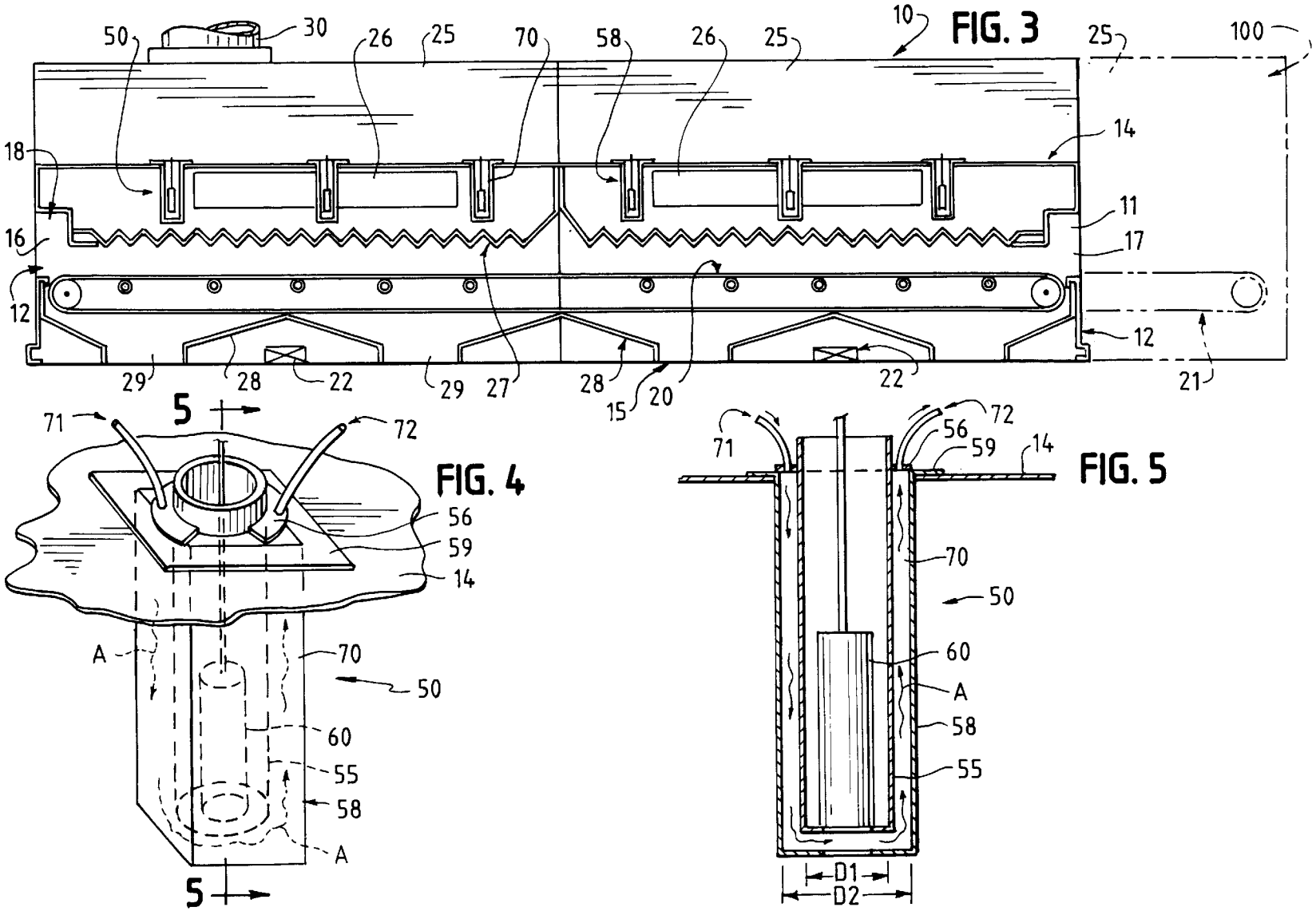
FIG. 3 is a sectional view along line 3—3 in FIG. 1.
FIG. 4 is a perspective detail of the sensor housing.
FIG. 5 is a sectional view along line 5—5 in FIG. 4.

Turning to FIGS. 1–3, a dryer assembly 10 is shown. The assembly includes a dryer housing 11 wherein the products passing therethrough are heated. The housing 11 is formed of opposed side walls 12, opposed end walls 13, a top wall 14 and a bottom wall 15. Such walls are generally constructed of sheet metal and with a double wall to keep the outer wall cool. At one end of the housing there is an entrance 16 and at the other end there is an exit 17. These entrances and exits are generally openings within the walls. A conveyor system 20 (here a looped belt with a plurality of aperture therein (as a screen)) is driven by a motor (not shown) and passes through the housing 11 between the side 12, top 14 and bottom 15 walls from the entrance 16 to the exit 17. The ductwork for the system is generally shown at reference number 25. A cooling/dehumidifying/chilling section 100 is also added. The conveyor 20 shown is totally retained within the dryer housing 11. Some conveyors extend beyond these openings to points outside the housing (shown in phantom (reference number 21 in FIG. 1).

Heater elements (shown schematically at reference number 22) are within (generally below the conveyor 20) or immediately adjacent the dryer housing 11. An intake blower and an in-line blower are positioned within or adjacent the housing. Ducts (represented by duct openings 26) bring the air into the dryer housing 11 above the conveyor 20. There are generally two blowers employed. One blower draws fresh atmospheric air into the system to mix with the gas and burn, and the second blower moves the heated air into the heating area above the conveyor.

In the embodiment shown, there are four (4) "zones" shown. The first zone (preheating zone) is just after the inlet 16 and in the vicinity of the separate infrared preheater 18 (FIG. 3). The second zone is in the vicinity of the first opening 26 for the heated air. The third zone is in the vicinity of the second opening 26 for the heated air. And, the fourth zone is in the chilling section (shown in phantom at 100). A plurality of overlapping heating air knives 27 (with slits therein) (FIG. 2) are disposed between the conveyor 20 and the duct openings 26 to the intake blowers and the heating elements 22 for ensuring consistent airflow and velocity to and across the entire width of the conveyor 20. As a result, heated, forced air is blown across the conveyor 20 and any products thereon.

A plurality of inclined deflectors 28 are located below the conveyor 20 for directing the air passing through the housing 11 and conveyor 20 to exhaust ducts (represented by duct openings 29). An exhaust blower is connected to the exhaust ducts 29 to transport the exhaust air to either a stack 30 for release into the surrounding atmosphere or back into the system 10 to recirculate the heated air and increase the assembly's efficiency.

While not shown, a circulation blower and blower filter screens are also employed. The system is also insulated to ensure safe use thereof.

In most systems, there is a means to detect the temperature inside the housing. Such means include industrial grade thermometers that measure the ambient air within the housing. This information is fed to the control panel 31 and displayed and assists an operator in deciding whether to manually adjust the conveyor's speed, the heat applied, and/or the air movement (cubic feet per minute—"CFM").

In the system of the present invention, this procedure is expanded upon in five (5) respects. First, the temperature is measured in several locations along the conveyor. Second, the temperature measured is not the ambient temperature of the surrounding environment, but rather the actual temperature of the product (textile/substrate) and/or ink thereon passing through the dryer housing on the conveyor. Third, the moisture content of the air is monitored in the system. Fourth, rather than applying only heat to the system, a chilling/dehumidifying system is incorporated into the dryer assembly. And, fifth, the decision process by the operator is modified.

Figure 7:
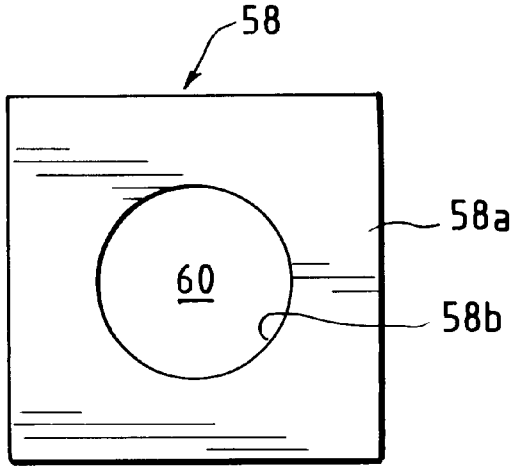
FIG. 7 is a sectional view along line 7—7 in FIG. 6.
Figure 8:
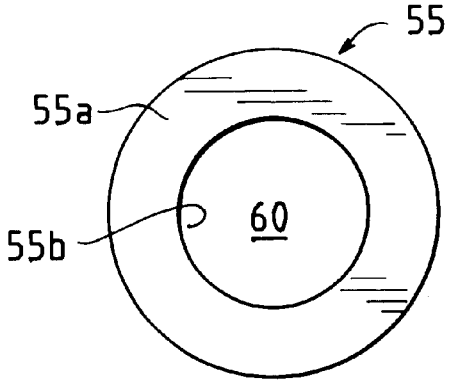
FIG. 8 is a sectional view along line 8—8 in FIG. 6.

As shown in FIG. 3, there are a plurality of longitudinally (along the conveyor) spaced apart sensor housings 50 between the entrance 16 and the exit 17 of the dryer assembly 10. These sensor housings 50 each hold a sensor 60 therein, and the sensor housings; project from the top wall 14 of the dryer housing 11 in a direction towards the conveyor 20. The sensor housings 50 each are comprised of concentric tubular members 55,58. By tubular, one means generally hollow with an outer shell, e.g., cylindrical, rectangular, square, etc. In the embodiment shown, the sensor housing 50 is rectangular (square) 58 on the outside and cylindrical 55 on the inside. Specifically, a first, outer sensor housing 58 is rectangular square) in shape having a second diameter or width D2 (FIG. 5). This housing 58 is composed of stainless steel and has an outwardly projecting flange 59 at one end for attaching it to the top wall 14 of the dryer housing 11. At the other end, there is an inwardly directed flange 58*a* with an opening therein 58*b*. This is shown in detail in FIGS. 6–8. A second, inner sensor housing 55 is cylindrical in shape and has a first diameter D1 (FIG. 5). The second diameter or width D2 is greater than the first diameter D1. This second, inner sensor housing 55 is also composed of stainless steel and has an outwardly projecting flange 56 at one end for attaching it to the top wall 14 of the dryer housing 11 or the flange 59 of the outer housing 58. At the other end, there is an inwardly directed flange 55*a* with an opening therein 55*b*. This, too, is shown in detail in FIGS. 6–8. The flanges 56,59 at the one end of both sensor housings 55,58 can be fastened or welded into place. For example, once the holes are made in the top wall 14 of the dryer assembly 11, the sensor housings 55,58 can be dropped through the holes. The flanges 56,59 on the sensor housings 55,58 stop the movement of the housings entirely through the holes.

The openings 55*b*,58*b* in the inwardly directed flanges 55*a*,58*a* are aligned with the opening 68 in the physical sensor unit 60.

An annular chamber 70 is thus formed in the annular space between the inner sensor housing wall 55 and the outer sensor housing wall 58. In practice, the inner sensor housing has a diameter of 1.51" (approximate) and a length of approximately 8", while the outer sensor housing has a width of 2.495" and a length of between 7.4" and 7.9" (approximate).

A first air-line 71 for carrying air into the annular chamber 70 is connected to and in communication with the annular chamber at the one end wherein the inner and outer sensor housings 55,58 are connected to the top wall 14 of the dryer 11. Similarly, a second air-line 72 for carrying air out of the annular chamber 70 is connected to and in communication with the annular chamber at the one end wherein the inner and outer sensor housings are connected to the top wall of the dryer. These air-lines 71,72 are diametrically opposed to one another. In short, in relation to the inner sensor housing 55, they are immediately outside the inner sensor housing and approximately annularly spaced 180 degrees apart. In this manner, as shown with flow (air) arrows (Air (A)) in FIGS. 4 and 5, air exiting the first air-line 71 enters the annular chamber 70 at a point adjacent the top wall of the dryer and travels longitudinally towards the opening at the other end of the annular chamber. The air then passes over the opening in the first, inner sensor housing 55 and is drawn into the annular channel 70 by the second air-line 72. The air next travels longitudinally within the annular chamber 70 towards the top wall of the dryer and the second air-line 72 acting as a vacuum. This second air-line 72 draws air in and receives the air and either exhausts it 30 or recirculates it.

Figure 6:
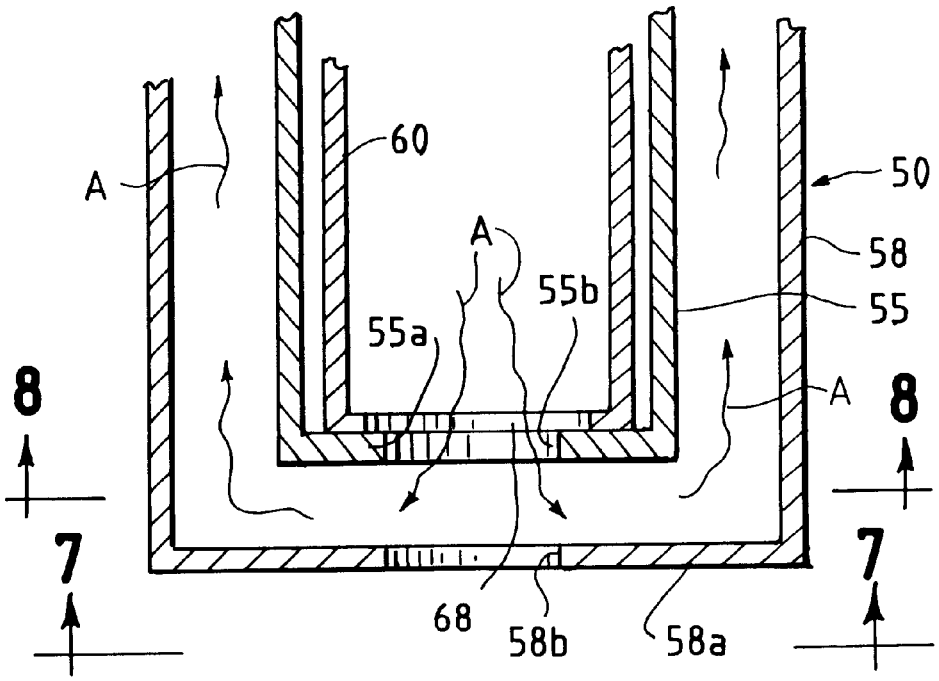
FIG. 6 is a larger sectional view of the lower portion of the sectional view shown in FIG. 5.

The actual sensor 60 is located within the inner sensor housing 55. As shown in FIG. 6, the clearance between the sensor 60 and the inner sensor housing 55 are minimized to prevent the sensor from moving. The sensor 60 is directed with its opening 68, lens 61 and sensor detector 62 towards the interior of the dryer housing and specifically towards the conveyor 20. In particular, the open end 68 of the sensor 60 rests on the inwardly directed flange 55*a* (FIG. 8) of the inner sensor housing 55. The preferred sensor is infrared-based and calibrated such that it senses the temperature of the textile/substrate and/or the printing (ink or plastisols) thereon as the textile/substrate passes thereunder. As shown in FIG. 3, there are six (6) sensors 60 in the dryer assembly 11. Each detects the temperature of the product passing thereinunder. A seventh sensor, though not shown, is positioned adjacent the separate preheater 18 near the inlet 16 of the assembly 10.

Figure 9:
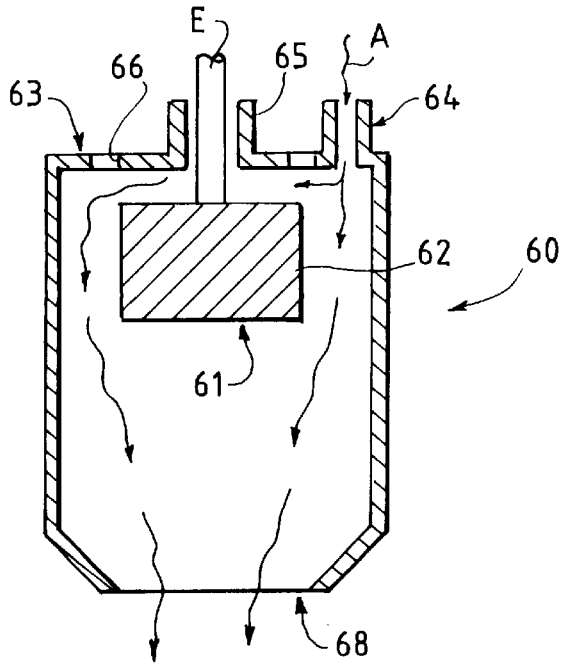
FIG. 9 is a sectional view of the sensor.

Suitable sensors are made by Exergen Corporation, 51 Water Street, Watertown, Mass., under Model Nos. IRt/c.5 and IRt/c.10 (Stainless Steel, Lensed Models). These sensors have 5:1 and 10:1 fields of view, respectively, twisted shielded base thermocouple wire, Teflon sheathed rated to 392° F., and are rated up to 212° F. ambient. They further have built in air purging and air cooling capabilities up to 500° F., and have target temperatures of from −50° F. to +1200° F. Model No. IRt/c.5 has a diameter of 1.375" and a length of 3.34". Model No. IRt/c.10 has a diameter of 1.375" and a length of 3.76". A general detail of the sensor is shown in FIG. 9. The sensor 60 has a first, closed end 63 with openings therein for the air (A) inlet 64, the electrical (E) connection 65 and the mounting holes 66. Standard fasteners can be used to connect this first end 63 to the top wall 14 of the dryer 11 or attached ends of the sensor housings 55,58. The sensor can also be suspended. As noted, in the embodiment shown, the open end 68 of the sensor 60 rests on the inwardly directed flange 55*a* (FIG. 8) of the inner sensor housing 55. An aligned opening 58*b* in the outer sensor housing 58 allows the sensor unit 60 to read the temperature outside the housings 55,58.

The air (A) is channeled within the sensor unit 60 between the inlet 64, through the sensor, and out the sensor through the opening 68 to cool the sensor detector 62 itself. This is an internal air purging system for cooling the sensor unit 60 and sensor detector 62.

As a result of the above construction, the sensor 60 has a built-in internal air purging system and a separate external air purging system (the airflow through the annular channel). Both purging systems cool the sensor unit. In addition, the inner and outer sensor housings further physically protect the sensor from the hot air being blown in the dryer.

Before actual use, the sensors are calibrated and tuned pursuant to the manufacturers'recommendations. Once in use, each sensor measures the target surface temperature as opposed to the ambient temperature. This enables a more accurate picture of the dryer's effect on the product.

For example, each of the sensor's readings can be transmitted to a control box 31 and a display attached to the dryer. Once this information is indicated, an operator can adjust the conveyor's speed, the heat applied in each section or zone, and/or the air movement (CFM) in each zone. The specific selections will depend upon the materials being dried and the ink used. In addition, a software program can control these variables. In such a program, the materials and parameters (e.g., drying times and temperature ranges) are compared with the temperatures sensed in the various locations and the program adjusts the dryer's conveyor's speed, heat applied, and air movement.

While not shown in the Figures, sensors can be situated to monitor the products immediately before or after entering the dryer and/or immediately before or after exiting the dryer. Such information is often useful and important to determine the speed in which products are heated (ramp-up time) and cooled (cool-down time).

Oftentimes, it is also important to monitor and control humidity in and around the dryer. For this purpose, the assembly of the present invention further includes humidity sensors. Specifically, humidity sensors can be placed inside and immediately outside the dryer. These, too, can be housed and spaced apart as the temperature infrared sensors. The preferred positioning of these humidity sensors are in the ducts between the chiller/dehumidifier (110 in FIG. 10) and in the exhaust lines after the heat exchanger (120 in FIG. 10).

A suitable humidity sensor is Vaisala, Inc., 100 Commerce Way, Woburn, Mass., under Model NoHMM 30C (for high temperature environmental chambers). This sensor has an operating temperature range of −40° F. to +320° F., and is rated up to 212° F. ambient. The sensor has a 12 mm diameter and a 200 mm length. The sensor is a HUMICAP® H-Sensor.

Thus, as above, once humidity is sensed and communicated, the air conditioner/chiller/dehumidifier 110 can be controlled. Or, the dryer's conveyor's speed, heat applied, and air movement can be further adjusted either manually or automatically.

Figure 10:
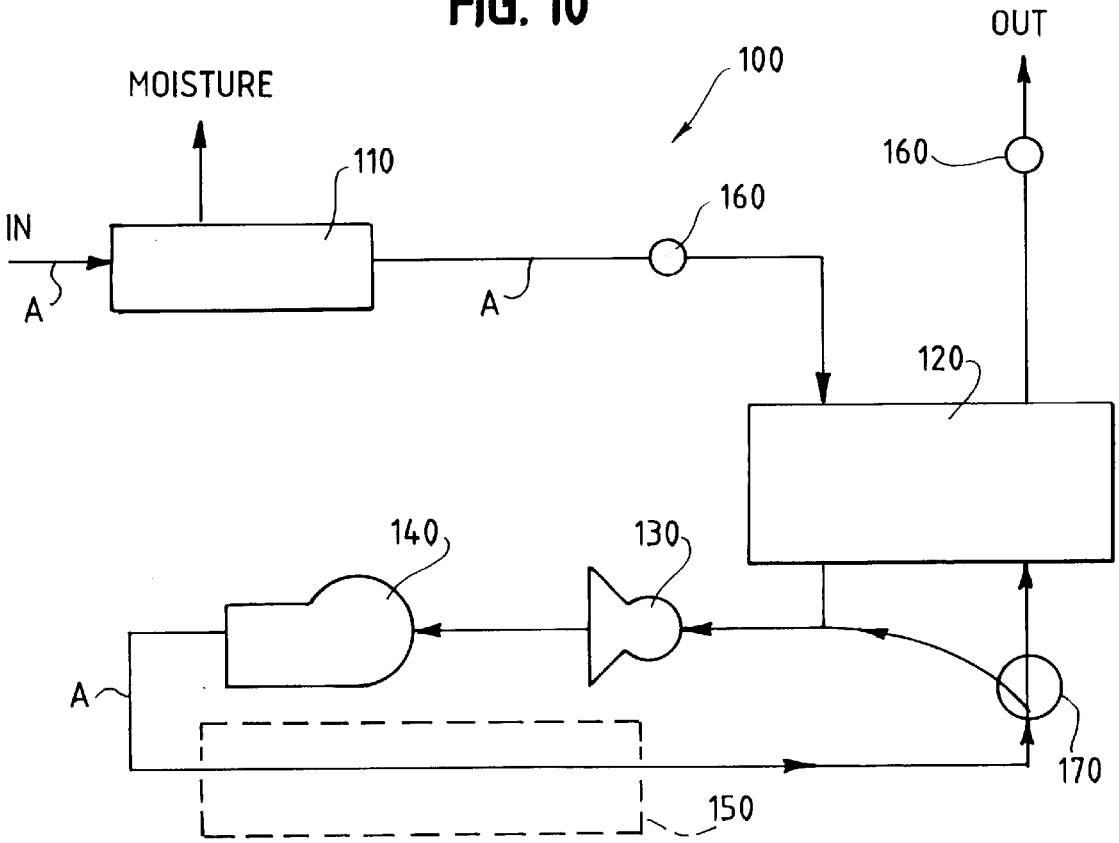
FIG. 10 is a schematic flow diagram of the system.

The cooling section 100, shown generally in FIGS. 1 and 3, is shown schematically in FIG. 10. As mentioned briefly previously, a cooling section 100 is added to the dryer assembly 10. This cooling section 100 is disposed between the heating section and the exit opening 17 to the dryer. In this cooling section, the product passing therethrough is cooled. One of the primary purposes of this section is to cool down the product so that workers removing products from the conveyor and exiting the assembly can handle the product. In prior systems, the products exit the system too hot to touch. Another purpose of the cooling system is to remove moisture from the air entering the assembly 10. The moisture in the air is removed prior to the air being mixed with the gas and burned.

The cooling section 100 includes an air conditioning, dehumidifier or chilling unit 110. The specifications for the system depend on the power and size requirements for the entire unit. Air normally fed into the burner from the surrounding atmosphere, is first drawn into the air conditioner/dehumidifier/chiller 110 wherein any moisture is drawn from the air. The dry air next passes through a heat exchanger 120 to preheat this dry air. From the heat exchanger 120, the dry air is moved to the burner units 130 wherein it is mixed with gas and burned. The blowers 140 direct this heated, dry air to the products on the conveyor 150. The exhaust air is next exhausted and passed through the heat exchanger 120. This hot, exhaustion heats the dry air from the dehumidifier in the heat exchanger 120. From the heat exchanger 120, the exhaustion is removed from the assembly.

While not shown in FIG. 10, the dehumidifier 110 cools the products on the conveyor 20 passing therethrough from the heated portion (150) of the assembly 10.

Humidistats or humidity monitors 160, as those just described, controlling the system 100 are located between the dehumidifier 110 and the heat exchanger 120 and just after the heat exchanger 120 on the exhaust side of the exchanger. A baffle 170 can be included in the system to recirculate the air. This baffle directs exhausting air back to the burner 130 wherein this air is mixed with gas and burned or directs the exhausting air to the heat exchanger 120 as described above. Ducts can be used to transport the air.

While the specific embodiments have been illustrated and described, numerous modifications are possible without significantly departing from the spirit of the invention and the scope of protection is only limited by the scope of the accompanying Claims.

We claim:

1. A dryer for curing substrates comprising:

a dryer housing having an entrance and an exit;

means for heating the substrates within the dryer housing;

a conveyor system for moving the substrates from the entrance to the exit; and, a plurality of sensors for sensing the temperature of the substrates within the dryer housing longitudinally spaced apart between the entrance and exit.

2. The dryer of claim 1 wherein the sensors are each infrared-based.

3. The dryer of claim 2 wherein each infrared sensor includes a sensor housing projecting into the dryer housing and an air purging system for cooling the sensor.

4. The dryer of claim 2 wherein each infrared sensor includes a sensor housing with an internal air purging system and a separate external air purging system, both purging systems cooling the sensor.

5. The dryer of claim 4 wherein the external air purging system is an annular chamber formed between an inner chamber wall and an outer chamber wall and an air-line carrying air into the annular chamber.

6. The dryer of claim 5 wherein the inner chamber wall is hollow, having an outer shell with a first diameter and the outer chamber wall is hollow, having an outer shell with a second diameter, the first diameter being less than the second diameter, both of the walls being secured at a first end to the dryer housing and being open to the inside of the dryer housing at a distal end.

7. The dryer of claim 6 wherein the air-line carrying air into the chamber is connected at the first end of each of the walls, and further including a second air-line connected at the first end of the walls removing air from the annular chamber, the air-line and the second air-line being annularly spaced apart.

8. A dryer for curing substrates comprising:

a dryer housing having an entrance and an exit;

means for heating the substrates within the dryer housing;

a conveyor system for moving the substrates from the entrance to the exit;

a plurality of longitudinally spaced apart sensor housings between the entrance and the exit extending from a wall of the dryer housing toward the conveyor system;

a sensor within each sensor housing sensing the temperature of the substrate passing thereby.

9. The dryer of claim 8 wherein each sensor housing is connected at a first end to a top wall of the dryer housing and open at a distal end, each sensor is infrared-based and includes an internal air purging system for cooling the sensor.

10. The dryer of claim 9 wherein each sensor housing includes an annular chamber formed between an inner chamber wall and an outer chamber wall, a first air-line carrying air into the annular chamber and a second air-line carrying air out of the annular chamber.

11. The dryer of claim 10 wherein the inner chamber wall and external chamber wall are concentric outer shells having hollow interior portions secured at a first end to the top wall of the dryer housing and being open to the inside of the dryer housing at a distal end, the sensor being contained within the inner wall and the first and second air-lines being annularly spaced apart and adapted to pass air from the first air-line and the annular chamber in a first direction over the openings in the walls and the sensor and in a second direction into the annular chamber and into the second air-line.

12. A dryer for curing substrates comprising:

a dryer housing having an entrance and an exit;

heating means for heating the substrates within the dryer housing;

a conveyor system for moving the substrates from the entrance to the exit; and, dehumidifying means for removing moisture from any air entering the dryer housing.

13. The dryer of claim 12 wherein the dehumidifying means cools the substrates within the dryer housing before the exit.

14. The dryer of claim 13 further including a heat exchanger wherein the dehumidified air is preheated by air exhausting from the dryer.

15. The dryer of claim 13 further including a humidity detector monitoring the moisture of the dehumidified air.

16. The dryer of claim 15 wherein the dehumidified air is burned by a burner unit.

17. The dryer of claim 16 further including a plurality of longitudinally spaced apart sensor housings between the entrance and the exit extending from a wall of the dryer housing toward the conveyor system.

18. A dryer for curing substrates thereon comprising:

a dryer housing having an entrance and an exit;

means for heating the substrates within the dryer housing;

a conveyor system for moving the substrates from the entrance to the exit;

a plurality of temperature sensors for measuring the temperature of the substrates within the dryer housing longitudinally spaced apart between the entrance and exit;

at least one humidity sensor measuring the air into the housing.

19. The dryer of claim 18 wherein the sensors are each infrared-based.

* * * * *